US005760330A

United States Patent [19]

Himmert et al.

[11] Patent Number: 5,760,330

[45] Date of Patent: Jun. 2, 1998

[54] METHOD AND APPARATUS FOR CONVEYING A LARGE-CALIBRE PAYLOAD OVER AN OPERATIONAL TERRAIN

[75] Inventors: Rainer Himmert, Lauf; Alfred Eckel, Röthenbach; Günther Thurner, Schwaig; Harald Wich, Lauf, all of Germany

[73] Assignee: Diehl GmbH & Co., Nürnberg, Germany

[21] Appl. No.: 811,687

[22] Filed: Mar. 5, 1997

[30] Foreign Application Priority Data

| | | | |
|---|---|---|---|
| Mar. 8, 1996 | [DE] | Germany | 196 09 012.1 |
| Jul. 31, 1996 | [DE] | Germany | 196 30 796.1 |
| Oct. 25, 1996 | [DE] | Germany | 196 44 380.6 |

[51] Int. Cl.[6] ..... F42B 12/62

[52] U.S. Cl. ..... 102/489; 102/337; 102/351; 102/357; 102/387; 102/374; 102/378; 102/393

[58] Field of Search ..... 102/337, 338, 102/340, 342, 351, 357, 386, 387, 374, 377, 378, 393, 394, 489, 388

[56] References Cited

U.S. PATENT DOCUMENTS

| | | | |
|---|---|---|---|
| 2,945,442 | 7/1960 | Adelman et al. | 102/378 |
| 3,185,090 | 5/1965 | Weber | 102/378 |
| 3,502,023 | 3/1970 | Britton | 102/340 |
| 4,498,393 | 2/1985 | Fisher | 102/489 |
| 4,614,318 | 9/1986 | Gobel | 102/489 |
| 4,726,543 | 2/1988 | Stessen | 102/386 |
| 4,876,963 | 10/1989 | Deffayet | 102/387 |
| 4,953,813 | 9/1990 | Postler | 102/387 |
| 4,955,813 | 9/1990 | Postler et al. . | |
| 5,111,748 | 5/1992 | Thurner et al. | 102/489 |
| 5,287,810 | 2/1994 | Aumasson et al. | 102/489 |

FOREIGN PATENT DOCUMENTS

| | | | |
|---|---|---|---|
| 20226A1 | 12/1980 | European Pat. Off. . | |
| 62750A1 | 10/1982 | European Pat. Off. . | |
| 0323839 | 7/1989 | European Pat. Off. . | |
| 350820 | 1/1990 | European Pat. Off. | 102/489 |
| 2679323 | 1/1993 | France . | |
| 2429912 | 1/1975 | Germany | 102/340 |
| 3111907 | 10/1982 | Germany . | |
| 3722038A1 | 1/1989 | Germany . | |
| 3806731 | 1/1989 | Germany . | |
| 3817265 | 11/1989 | Germany . | |
| 3901882 | 4/1990 | Germany . | |
| 4304058 | 8/1994 | Germany | 102/489 |
| 295671 | 5/1965 | Netherlands | 102/357 |
| 1258044 | 12/1971 | United Kingdom | 102/377 |
| 2174482 | 11/1986 | United Kingdom . | |
| 2219651 | 12/1991 | United Kingdom . | |

OTHER PUBLICATIONS

Karcher, "Mobile Verpflegungs–Systeme," 1991, 30 and 31.

*Primary Examiner*—Harold J. Tudor
*Attorney, Agent, or Firm*—Scully, Scott, Murphy & Presser

[57] ABSTRACT

A delivery apparatus (11) for full-calibre submunitions or the like payloads (12) which are coaxially stacked in its load space (19) results in a system which operates in a fault-free manner when, for ejecting the payloads (12), detachment of the load space (19) from the rocket motor (17) disposed therebehind and detachment of the ogive (14) from the opposite end of the load space (19) are each promoted by a pyrotechnic charge (28, 31), with the load space (19) being braked as a result of being positioned transversely beside the trajectory (26) of the separated motor (17) which flies further along the trajectory and past the load space in a stable configuration and with the load space (19) only then being turned by a braking parachute (23) connected to its end (22). The load space tail (18) which thereafter then faces forwardly in the direction of flight is opened by detachment of a cover (25) and the load space (19) is pulled away from the payload stack (12—12) by means of the braking parachute (23).

9 Claims, 3 Drawing Sheets

METHOD AND APPARATUS FOR CONVEYING A LARGE-CALIBRE PAYLOAD OVER AN OPERATIONAL TERRAIN

BACKGROUND OF THE INVENTION

1. Field of the Invention

The present invention relates to a method of delivering a payload, such as a mine or submunition, through the intermediary of a projectile over an operational terrain above which the payload is axially discharged from the projectile. The invention further relates to an apparatus for implementing the inventive method.

2. Discussion of the Prior Art

The integers forming the introductory portions of the claims are known from U.S. Pat. No. 5,111,748 for conveying seeking fuse submunitions by means of a carrier projectile. Over the operational area a pyrotechnic ejection charge arranged in the region of the ballistic ogive of the carrier is fired to eject the submunitions rearwardly (in the opposite direction to the direction of flight) out of the payload space of the projectile.

DE 31 11 907 A1 discloses an apparatus of a similar general kind, in which, over the no-go or prohibited area, a hollow-cylindrical distribution unit is ejected out of the carrier projectile axially in the direction of flight, with the projectile ogive being blown off. In that situation, a braking parachute is deployed for the distribution unit. A further pyrotechnic charge is then activated in order to eject the full-caliber submunitions out of the distribution unit rearwardly, that is to say in the opposite direction to the direction of movement, with the braking parachute which is connected at that location being detached. The coaxial stack of mines which is thereby braked relative to the movement of the distribution unit is then to be released from its aerodynamically stable combination, insofar as mine parachutes are successively opened, by means of which the individual mines are braked independently of each other and drop down into the no-go or prohibited area. It is not to be expected however that a system of that kind operates in a collision-free manner since the braking parachute for the distribution unit is already in danger of collision due to the carrier projectile which is rapidly approaching it in flight from behind, and rearward ejection out of the distribution unit does not guarantee trouble-free opening of the individual mine parachutes for separation of the combination stack thereof. Furthermore, it will scarcely be possible in a practical situation also to use the parachute for separation of the stack, for providing a sufficient braking effect for a safe drop to the ground. Finally the use of a separate distribution unit within the conveyor carrier involves a reduction in the submunition payload.

To a certain extent it is more desirable for large-caliber submunitions to be ejected from the carrier in the manner shown in FIG. 2 of DE 38 06 731 A1 by means of inflatable gas tubes in a radial direction, that is to say by breaking open the carrier casing along desired-rupture locations, transversely relative to the flight path. However breaking the carrier open radially in that way is structurally expensive and difficult to reproduce; in particular however the lateral arrangement of ejection gas tubes involves a reduction in the mine diameter relative to the submunition caliber which is possible per se (according to the inside diameter of the carrier), and it involves an asymmetrical submunition packing configuration which is disadvantageous in terms of the structure and the flight characteristics of the carrier. Similar measures are known in connection with conveying armorpiercing mines by means of the artillery rocket MLRS-AT2 (see WEHRTECHNIK 9/91, 30/31 bottom of the page), in which case however firstly mines which are still grouped in scatter containers are urged radially outwardly by a central gas bag after the payload space casing has been cut open in parallel relationship to the axis.

For reasons of strength, it is not readily possible to provide for axial or radial distribution of the payloads, initiated by a pyrotechnic ejection charge, if the objects to be distributed are of very high mass, such as for example smoke pots or generators or relatively large submunitions, and if in that respect in particular the situation involves so-called surface defense mines which are positioned in oriented relationship in the operational terrain (see GB 2 219 651 A) in order in the event of an approach of a potential target object, for example to launch a missile in the manner of a seeking fuse submunition from a directable receptacle, as described in greater detail by way of example in GB 2 174 482 A.

The object of the present invention is therefore that of developing a method and apparatus as described herein, in such a way that even such critical payloads can be operationally reliably released from a delivery projectile over the operational territory.

SUMMARY OF THE INVENTION

The solution according to the invention is thus distinguished both in terms of the method and also in terms of the apparatus for the delivery of large-calibre payloads, in that activation of stabilization elements for a payload space which is separated from the tail and which has thereby become aerodynamically unstable is effected with a delay in order to avoid a premature increase in volume which is involved in the braking procedure, until the tail motor which has been separated off has aerodynamically stably flown past the payload space which is spinning out of the trajectory. After that braking sails can be deployed (see U.S. Pat. No. 4,726,543) or a parachute connected to the casing of the payload space is spread out in order to turn the casing with the open separation location leading into the direction of movement and to brake it relative to the inertia mass of the payload and thereby to cause the payload to glide forwardly out of the casing in the direction of flight.

Desirably, immediately after separation of the motor from the payload space, a rapid rise in the differential speed as between the payload space and the rocket motor which has been blown away from same is initially guaranteed by means of a separation charge so that the motor which continues to fly on in a directionally stable manner does not remain in the wind shadow or lee of the load space, but the load space can pivot in a collision-free manner out of the still stable flightpath of the motor and is already effectively decelerated relative thereto by the transverse flow thereagainst which occurs in that way. Then, by separation of the ogive in front of the load space, a braking parachute is released, which is fixed to the end of the load space with a relatively short twist line and which can now be deployed for a further reduction in speed and for a new orientation of the load space, without a risk of collision in regard to the motor which has been separated off and which has already flown past towards one side. The parachute thereafter orients the load space tail which originally faced in the opposite direction to the direction of flight, stably forwardly in the direction of flight, whereupon a cover is detached and now therefore, as a result of the braking parachute effect, the load space casing is pulled off the submunition stack, in opposition to the direction of movement thereof. Thereby the submunition stack is pushed out in a reproducible fashion, quickly and reliably, in spite of the dynamic pressure caused by the approaching air flow in front of the load space and in spite of the reduced pressure in the load space and against the frictional forces at the inside wall of the load space, the reduced pressure obtaining in the load space is not only compensated by an ejection aid in the form of a gas generator, as is commercially usual in a motor vehicle airbag, but it is even preferably over-compensated in order to overcome any forces tending to prevent ejection, thereby to assist the pulling force of the parachute. For that purpose therefore (contrary to the factors involved for detachment of the motor), preferably no explosive charge is used, but rather the procedure employs the gas generator which produces a more careful and gentler effect so that the submunitions that can be used can also be the mechanically relatively sensitive surface defense mines with their outwardly disposed bar structures of support and mounting arrangements which therefore first fill the charge cross-section over the full caliber, as are known from DE 38 17 265 A1.

In order that the gas pressure of the ejection aid can be allowed to act in an optimum fashion on the stack of submunitions to be pushed out, and in order in that respect to avoid pressure losses along the bar structures at the inside wall of the load space, the generator can be fitted into an inflatable gas bag, the deployment of which assists with sliding movement of the submunition stack out of the load space. If however the inflation characteristics of the collapsed gas bag are critical in terms of time or geometry, then a pressure distribution plate which acts in a piston-like manner, behind the parachute chamber of the submunition which is the last to be pushed out of the load space, is then more appropriate. In order that the plate is reliably detached from the last submunition to be ejected and then the parachute chamber can be opened, the plate remains tethered to the load space by means of a line eccentrically engaging same.

That tethering arrangement can serve at the same time as a holding means for a pull-out line which, behind the last submunition of the stack which is pushed out of the load space forwardly in the direction of flight, opens a small pilot parachute or drogue in order to separate that rearmost submunition from the stack, and thereby then to tension a corresponding pull-out line from the submunition which is moving away, to the pilot parachute or drogue on the element, which is now the last one, in the remaining stack of submunition and so forth. In regard to the length of the pilot parachute pull-out lines, it is to be noted that it does not exceed the respective sum of the axial height and the diameter of a submunition because otherwise after separation of the preceding pilot parachute, knotting entanglement with its own rearward pilot parachute could occur and that could cause a disturbance in further parachute release procedures. For, those pull-out lines are each detached from the respective opened pilot parachute which thereafter activates the actual main or mine parachute, which is to be released in a time-controlled manner for opening, for the drop into the terrain in question (or previously also an auxiliary parachute for further deceleration of the mine flight movement). A certain gliding characteristic can be imparted to each mine parachute in order to provide for wider distribution of the downwardly moving mines over the no-go or prohibited area, irrespective of the effects of ground wind.

This therefore ensures reliable separation of the submunitions which are disposed in the rocket payload space in the full caliber thereof, even in the event of using relatively delicate items of equipment such as surface defense mines which are to be delivered by air.

For the three separation procedures (at the tail motor, at the ogive and later at the load space tail cover which faces forwardly in the direction of flight), it is possible to use connections which are own off or sheared off by pyrotechnic means, as are known as such from EP 0 323 839 A2 or DE 39 01 882 A1 (even if there they are structurally designed for other functions); or explosive cords or cutting charges which extend around the hollow-cylindrical inside peripheral surface result in desired-rupture locations being blown open (which as such however is not subject-matter of the present invention).

If the ogive is to be detached from the end region of the load space in order to free a braking parachute for the load space, then the transitional region between the ogive and the load space is acted upon by heavy flexural stresses because the ogive-load space combination which is already separated from the rocket tail motor pivots laterally out of the previous ballistic trajectory of the rocket (FIG. 3) and in so doing is subjected to a strong transverse flow of air thereagainst. Nonetheless it is necessary to ensure that the ogive reliably separates from the end of the load space and that deployment of the braking parachute coupled to the load space is not impeded. In accordance with an advantageous development, that is achieved in that provided between the load-bearing ogive structure and a load space end plate is a separable connection in the form of a coaxial cylinder guide whose frictional engagement must be overcome for the separation procedure by the reaction gas pressure of an ejection charge. In spite of the transverse stresses which result in not entirely negligible bending of the ogive longitudinal axis relative to the load space longitudinal axis which is connected coaxially in itself, there are no additional frictional forces which impede the separation procedure and which can scarcely be predicted in structural terms, if in that case, immediately upon the onset of the axial relative movement between the ogive and the load space, radial support of the ogive structure is released from a radially extending collar in front of the load space end plate.

BRIEF DESCRIPTION OF THE DRAWINGS

Additional alternatives and developments as well as further features and advantages of the invention are apparent from the following description of a preferred projectile according to the invention which is diagrammatically shown not to scale and in highly abstracted form in the drawing, being restricted to what is essential, for carrying out the method according to the invention which is also shown in the drawing.

FIG. 3 shows the approach flight of the rocket over the no-go or prohibited area, FIG. 4 shows the situation immediately after separation of the rocket motor, FIG. 5 shows the situation shortly after separation of the ogive, FIG. 6 shows ejection of the submunitions from the turned load space, FIG. 7 shows separation of the delivered submunition stack, and FIG. 8 shows the downward movement of the submunitions which have been separated from each other.

DETAILED DESCRIPTION OF A PREFERRED EMBODIMENT

Figure 1:
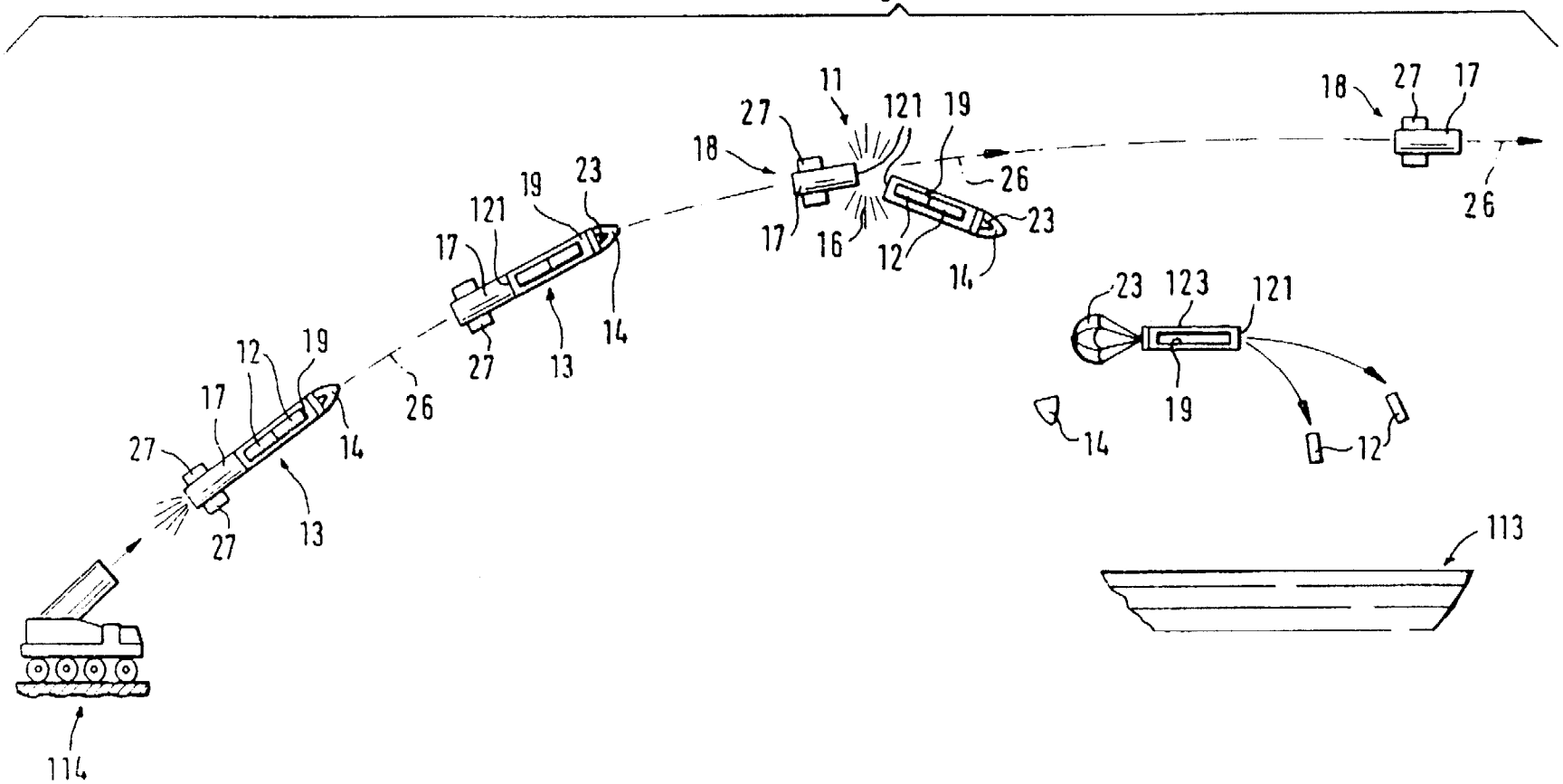
FIG. 1 is a view showing a scenarios for carrying out the method according to the invention.

The projectile diagrammatically shown in the scenario view in FIG. 1 for delivering a large-calibre payload is an artillery rocket 11, for example for delivering at least one so-called surface defense mine as a payload or submunition 12 into the operational terrain 113, a potential battle area which is to be blocked against the passage of armored vehicles. The rocket 13 which can be launched from a mobile launcher 114 is provided with a stabilizing tail plane assembly 27 at the rearward end of its tail motor 17. It brings the rocket 13 during a thrust period of only short duration into a ballistic flight path or trajectory 26 over the operational terrain 113. Extending between the tail portion 18 of the rocket 13, which is substantially occupied by the motor 17, and its ballistic front cover or cap 14 is the hollow-cylindrical payload space 19 for accommodating for example at least one mine which is to be ejected in the manner of submunition 12 over the operational terrain 113. In the illustrated embodiment the payload space 19 is filled by two such full-caliber mines 12 which are arranged coaxially one behind the other.

After the rocket, after the rocket motor 17 has burnt out, has covered the major part of the difference from the launch site (launcher 114) to a position over the operational terrain 113 in a drive-less or coasting mode on the trajectory 26, preparation begins for discharging the payload 12 over the operational terrain 113. For that purpose the tail motor 17 and therewith the entire tail portion 18 of the rocket 13 is detached, behind the payload space 19. That is desirably effected by time-controlled or remote-controlled initiation of a pyrotechnic separation charge 16, by means of which for example anchoring screws which are arranged parallel to the axis, between the central and the tail segment (payload space 19, motor 17) of the rocket 13 are separated, as is described in greater detail by way of example in U.S. Pat. No. 4,953,813 for a structurally and functionally similar situation of use. If however the situation here involves a rocket 13 with a casing 123 which extends continuously over the tail motor 17 and the payload space 19, then a separation charge is provided in the transitional region 121 which is to be separated, the separation charge being in the form of a cutting charge extending around the hollow cylinder at the inside wall thereof and which acts radially outwardly therearound, as a cutting means 16, that is to say in practical terms an explosive ring which bears radially against the inside peripheral surface of the hollow cylinder with a V-shaped insert which also extends therearound and which is of an acute-angled configuration and which opens radially outwardly.

After separation of the region 121 the tail part 18 with the motor 17 continues to fly substantially along the current ballistic trajectory 26 by virtue of the stabilizing effect of its tail plane assembly 27. In contrast the payload space 19 which is detached therefrom is now aerodynamically unstable and therefore performs swinging movements, with the necessary consequence that air flows thereagainst in inclined and transverse directions so that this detached front region of the rocket 13 departs from the previous trajectory 26. In this phase of operation, in accordance with the invention, no additional aerodynamic braking means are yet released, in order to keep as small as possible the cross-section of the payload space 19 which has been separated from the motor 17 and which has come out of the trajectory 26 thereof, until the motor 17 has passed it, without collision, by moving along its stable trajectory 26.

Therefore, upon activation of the separation procedure in the region 121 a (electronic or pyrotechnic) delay member is started, which, with an adequate safety margin, releases aerodynamic braking means, on the load space 19 which has moved away from the trajectory 26, only when it is certain that the tail portion 18 with the motor 17 has long flown past the payload space 19 on the trajectory 16. In the illustrated example the aerodynamic braking means involved is a braking parachute 23 which is connected to the casing 123 of the payload space 19, opposite the separation region 121 which is open at the end. It is released for example by the ogive cap or cover 14 being pyrotechnically blown off; the parachute 21 was enclosed in the region of the ogive cap or cover which is connected to the casing 123. By virtue of the parachute 23 then being deployed and tightening its lines, then—as a result of the braking action of the parachute 23—the payload space 19 which is still moving substantially parallel to the original trajectory 26 but already oriented inclinedly relative thereto is turned about to such a degree that now the open separation region 121 faces forwardly in the direction of flight. Since the casing 123, by virtue of its coupling to the braking parachute 23, is severely braked relative to the movement of the submunition 12 which is governed by inertia, the submunition 12 now slides in the direction of flight, that is to say forwardly, out of the payload space 19, in order then to drop down towards the operational terrain 113. That dive however is finally braked by means of a further parachute, in the interests of providing for a soft landing, as described in greater detail in above-mentioned prior publication GB 2 219 651 A.

Figures 2, 3, 4, 5, 6, 7, 8:
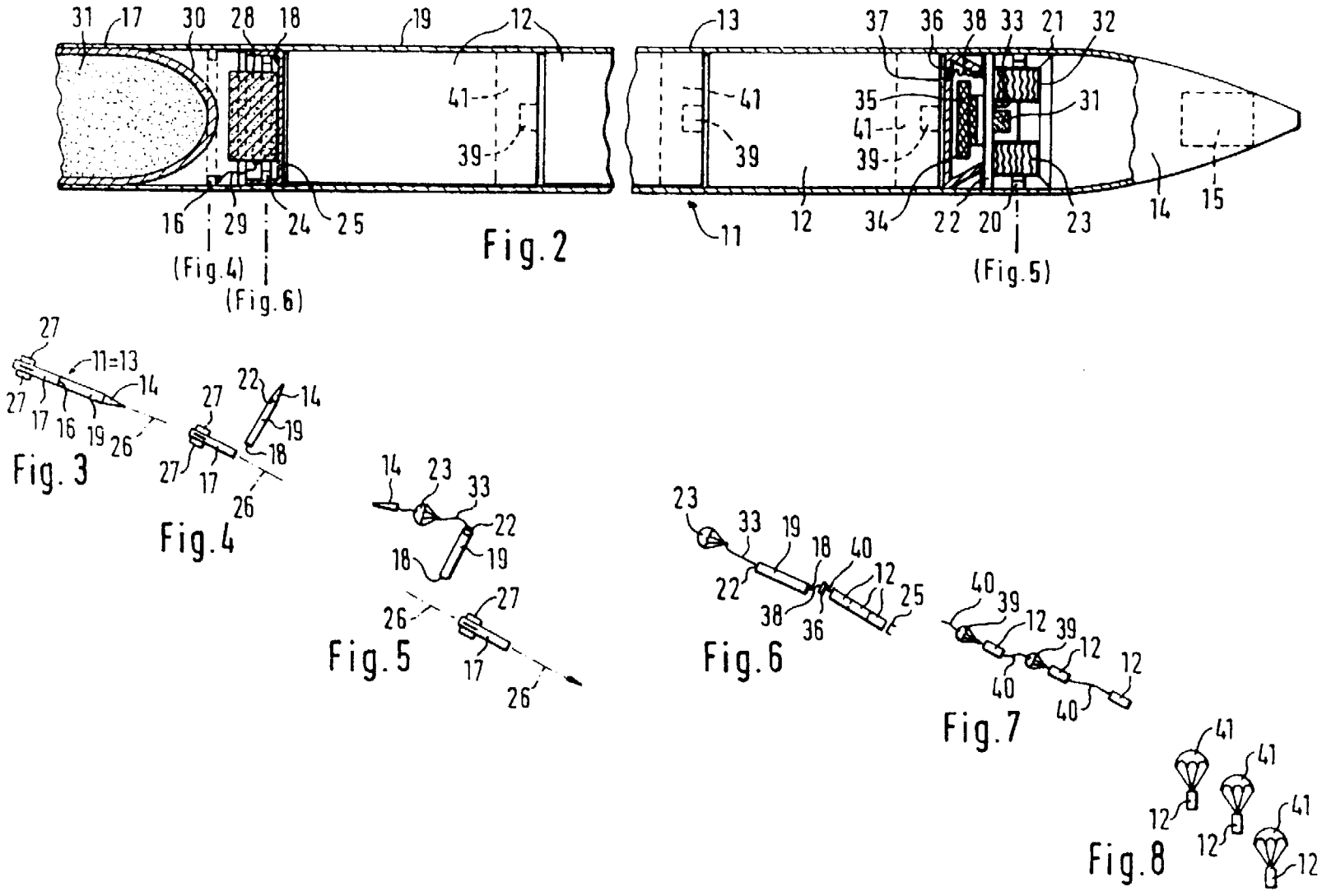
FIG. 2 is a broken-away view in longitudinal section of a rocket designed in accordance with the invention.
FIGS. 3 to 8 show the delivery procedure from a rocket as shown in FIGS. 1 and 2, more specifically
Figure 9:
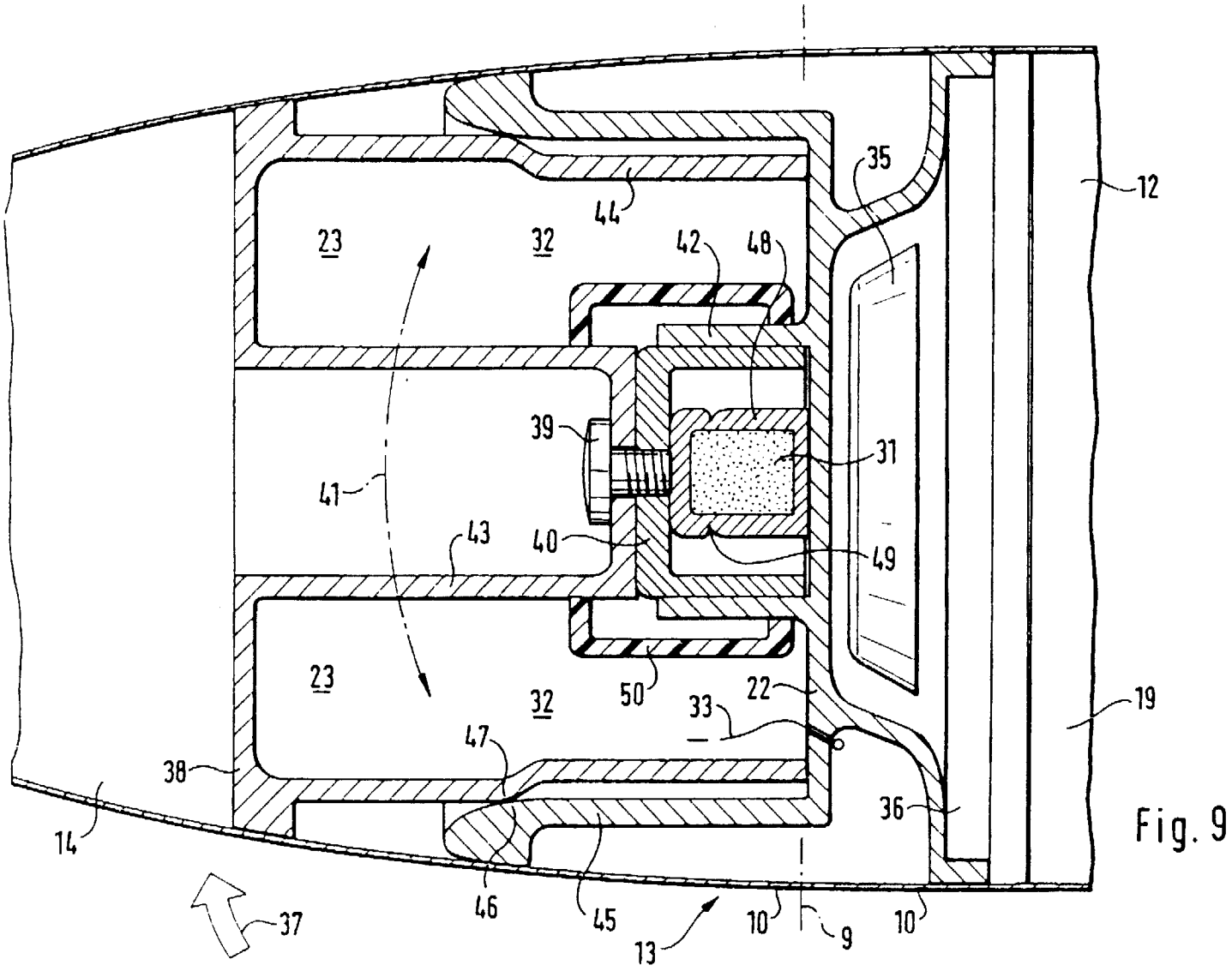
FIG. 9 is a broken-away view in longitudinal section of the transitional region from the load space to the ogive which has not yet been detached as shown in FIG. 5.

The apparatus shown in FIG. 2, for large-caliber submunitions 12, is also preferably an artillery rocket 13 in accordance with the system MLRS/MARS. In its ogive which is designed as a ballistic cover or cap 14, it includes a time fuse 15 for initiating a separation device 16 between the rocket motor 17 and the tail 18 of the equal-caliber load space 19 disposed axially in front thereof, for delivering the full-caliber submunitions 12. A further separation device 20 is provided in the transitional region 21 from the ogive 14 to the load space 19. It serves for the above-mentioned operation of releasing the structural connection at that location, releasing the braking parachute connected to the end 22 of the load space 19.

Finally, there may also be a further separation device 24 in the region of the load space tail 18 in order to be able to remove a tail closure cover 25 and to allow the submunitions 12 to slide forwardly out of the load space 19 coaxially through the tail 18 which then faces forwardly.

When (FIG. 3) the delivery unit 11, that is to say the rocket 13, in its secondary-ballistic phase—with the rocket motor 17 burnt out, in the falling section of an elongated ballistic curve—reaches the region above the no-go or prohibited terrain 113 which is predetermined by the time fuse 15, the motor separation device 16 is activated by the fuse 15. As a result (FIG. 3) the rocket motor 17 on the one hand and the load space 19 on the other hand together with the ogive 14 are separated from each other. The load space 19 becomes dynamically unstable due to the detachment of its hitherto flight-stabilizing tail extension, and it therefore tilts out of the original ballistic gravitational flight path or trajectory 26 into a transverse position which is advantageous in terms of flow thereover. The motor 17 with its greater ratio of mass to resistance area and with its stabilizing fins 27 in contrast moves substantially further along the previous trajectory 26 in stable flight and overtakes the load space 19 (FIG. 4-FIG. 5).

A problem here however is causing the load space 19 to move away in a trouble-free manner for it to drift laterally out of the trajectory 26 of the rocket motor 17 since the motor 17 is flying in a directionally stable fashion literally in the wind shadow or lee directly behind the load space 19 which is braked by the dynamic pressure in front of the ogive 14. The result of this is that, in spite of activation of the motor separation device 16, the motor 17 then straightaway closes up again to the load space tail 18 so that the two components still form a combination which is still relatively stable in terms of its flight and out of the trajectory 26 of which the load space 19 cannot swing so quickly (in order to be decelerated as a result of the transverse air flow acting thereon, out of the way of the trajectory 26 of the motor 17, for the motor to overtake it quickly and without collision). In order now to promote that desired operational procedure by producing rapid separation as between the motor 17 and the load space 19, arranged behind the load space tail 18 is a pyrotechnic explosive charge 28 which is fired for example by way of a firing line 29 in dependence on the function of the motor separation device 16. The reaction gas pressure which builds up very quickly acts between the load space tail 18 which is reinforced by the cover 25, and the curvature portion 30 of a tank 31 of the rocket motor 17, which curvature portion 30 is of a stable shape and surrounds the assembly in a hollow-cylindrical configuration, and thus the reaction gas pressure causes the motor 17 and the load space 19 to move axially quickly away from each other with a defined movement. By virtue of that positive movement of the load space 19 away from the motor 17, the spacing therebetween quickly becomes sufficiently large for the load space 19 to swing out laterally for the collision-free braking phase for the load space 19, relative to the motor 17 which flies on in a stable trajectory (FIG. 4).

Then, an ogive separation device 20 is activated with a pyrotechnic time delay, relative to the functioning of the motor separation device 16, at the load space 19 which is still wobbling in free flight. The ogive cap or cover 14 is only to lift axially away from the load space end 22 (and thus release the braking parachute 23 for deployment, the parachute 23 being coupled to the load space 19 by way of a twist line 33), when the motor 17 has already flown past so that it can no longer collide with the parachute 23 which inflates behind the short line 33 (FIG. 5). Once again an ejection charge 31—now between the ogive 14 and the load space end 22—serves for the rapid build-up of a relative speed, which is as high as possible, between the two components, in order to increase the spacing therebetween as quickly as possible so that now the ogive 14 does not collide with the parachute 23 which almost suddenly deploys and thus produces a braking action.

In the transitional region 9 between the ogive 14 which is in the form of a ballistic cover or cap and the hollow-cylindrical load space 19, the casing 10 of the rocket 13 has a desired-rupture location which is separated when the ogive 14 is detached substantially coaxially from an end plate 22 in front of the load space 19. That separation procedure is initiated in a timed fashion by firing of a low-pressure ejection charge 31 which then burns away uniformly after the load space 19 with ogive 14 has moved away from the rocket tail motor 17 and has pivoted sideways out of its ballistic trajectory 26, as shown in the succession of FIG. 4 and FIG. 5. The problem arises however that the combination of the ogive 14 and the load space 19 is subjected to the effect of very high transverse forces 37 acting thereon, due to the transverse air flow thereon. Flexural and tilting phenomena which result therefrom can prevent the defined separation procedure, which is to be achieved, for release of the parachute 23 stowed in the ogive 14 (for aerodynamically braking and stabilizing the load space 19 for trouble-free discharge of the submunitions 12).

In order to ensure that the ogive cap or cover 14 lifts away from the end plate 22 of the load space 19 axially in as reproducible a fashion as possible, in spite of the flexural loading on the transitional region 9 from the load space 19 to the ogive 14, the load-bearing structure 38 in the tail region of the ogive 14 is connected in butting relationship by way of a central pin 39 to a hollow piston 40 which is disposed coaxially therebehind and which in turn is guided by a hollow cylinder 42 coaxially surrounding it, and is closed towards the load space end plate 22. To provide for that assembly the centre of the load-bearing ogive structure 38 is extended in a cup-like shape towards the load space 19 where it bears flat as the cup bottom portion against the forwardly facing end portion of the hollow piston 51 if the transverse forces 37 are precisely not resulting in those two faces bearing against each other at a slight angle. A comparatively high degree of flexibility, particularly low flexural strength, in respect of the central pin 39 permits that pitching movement 41 of the ogive structure 38 carrying the rocket casing 10, relative to the hollow piston 51 which in turn is disposed in flexurally stiff relationship in the hollow cylinder 42 coaxially in front of the load end plate 22 (being held or formed thereon).

Thus in the transitional region 9 the ogive enjoys axially displaceable radial guidance in the vicinity of its longitudinal axis. Added to that is peripheral radial support near the casing 10 relative to a flange or collar 45 which, open in a forward direction, extends coaxially in front of the end plate 22 of the load space 19 into the interior of the ogive 14. A stowage compartment 32 for the load space braking parachute 23, which is connected to the load-bearing ogive structure 38 in one piece or in a multi-piece construction and which is annular by virtue of the central cup 43 and which is open towards the load space 19 projects at a radial spacing between the annular wall 44 and the collar wall 45 from the front into the collar 45. It is only in the vicinity of the end of the hollow-cylindrical collar wall 44 that the arrangement provides for radial mutual support as between its spherical contact region 46 and an outward bulge portion 47 in the generatrix of the annular wall 44. Thus, the load-bearing ogive structure 38, with flexing and bending of the central pin 39 upon tilting relative to the hollow piston 51, can tilt slightly out of the longitudinal axis of the load space 19 without jamming. More specifically, because of the spherical support pairing configuration 46–47, that situation does not involve unpredictable tilting and jamming phenomena, as would be feared for example in the case of cylindrical surfaces which were guided one within the other. The drawing takes account of the fact that desirably the central coupling region between the ogive 14 and the end plate 22 is enclosed by a resilient sleeve 50 in order to prevent fabric of the parachute 23 from becoming jammed there in the working gap between the end surfaces which are held together by the pin 39, and suffering damage.

In order to lift the ogive 14 away from the end plate 22, a low-pressure ejection charge 31 between the end plate 22 and the hollow piston 51 is fired; as it burns away uniformly the low-pressure ejection charge 31 results in an increasing reaction gas pressure in a bursting capsule 48 which surrounds the charge 31, until discharge flow bores which are closed by a foil are torn open by the increased pressure. The reaction gas pressure of the burning charge 31 can then produce its effect in the interior of the hollow piston 51 until a desired-rupture location 49 which extends around the bursting capsule 48 tears open to move the hollow piston 40 away from the end plate 22—the piston being guided coaxially in the hollow cylinder 42—and therewith also to displace the load-bearing ogive structure 38 away from the load space 19, breaking open the desired-rupture locations of the casing in the transitional region 9. By virtue of the hollow piston lifting away from the end plate 22 the annular space which extends peripherally between the central cup 43 and the hollow cylindrical wall 44 of the load-bearing ogive structure 38 and which serves as the compartment 32 (stowage compartment) for the braking parachute 23 is opened rearwardly (towards the load space 19) in order here to pull the braking parachute 23 out of the compartment by means of a line 33 connected to the load space 19, and thereby release the parachute for deployment thereof.

That movement of the compartment 32 away from the end plate 22 of the load space 19 occurs when the build-up of the reaction gas pressure in the interior of the hollow piston 40 results in an axial force which is greater than the structurally predeterminable frictional force along the cylindrical surface between the hollow piston 51 and the hollow cylinder 42 which embraces it for the axial guidance effect. Additional frictional forces which in particular cannot be predetermined and which could delay or even prevent the movement of the compartment 32 away from the end plate 22 are excluded because, when the compartment 32 moves axially away from the end plate 22 the support pairing configuration between the contact region 46 and the outward bulge portion 47 (such pairing being inclined in a funnel-like configuration relative to the longitudinal direction in the manner of an axially very short hollow truncated cone) separate from each other and as a result the radial spacing between the hollow cylindrical wall 44 and the collar wall 45 surrounding it is increasingly enlarged and therefore frictional and jamming phenomena cannot in any way occur there.

After the ogive 14 has moved away without any complication in that manner, in spite of the transverse load 37, and drifts laterally away in the direction of the load 37, the braking parachute 23 which in that case is pulled rearwardly out of the annular compartment 32 can be deployed without any risk of collision and can tighten the connecting line 33 to the end plate 22 of the load space 19 in order to swing it around and then (sequence shown in FIGS. 4 and 5) to eject the large-calibre submunitions 12 forwardly in the current direction of flight, with the support of the gas volume delivered by the gas generator 35 behind the end plate 22.

The parachute 23 which is released from its stowage compartment 32 when the ogive 14 moves away, because it is connected to the load space end 22 by means of the line 33, provides accordingly that the load space 19 is braked at one side so that the load space 19 is finally turned through 180° relative to the approach flight direction (FIG. 3) in a new stable flight position (FIG. 6), and now therefore for a certain free flight period faces forwardly in a stable condition with its tail 18 leading in the direction of movement.

A time delay for firing of the tail separation device 24 now runs and the cover 25 which now opens forwardly in a cup-like shape and in which previously the separation charge 28 for detachment of the motor 17 was burnt is released from its structural assembly to the load space 19. As a result the tail 18 of the load space 19 is opened for discharge of the submunitions 12 forwardly in the direction of movement relative to the rearward removal of the hollow-cylindrical load space 19 by means of its braking parachute 23 (FIG. 6).

That delivery procedure is therefore effected by the parachute 23 being coupled to the end 22 of the load space 19 and thus braking it with respect to the ballistic inertia-induced movement of the submunitions 12 which as a result, due to inertia, can slide out of the cylindrical interior of the load space 19 coaxially forwardly through the tail 18. Such inertia-induced delivery is however resisted by the braking frictional forces between the bar structures on the outside peripheral surfaces of the submunitions 12 and the inside peripheral surface of the load space 19 and the kinetic dynamic pressure in the open air in front of the submunitions 12 and a reduced pressure which is built up in the load space 19 behind the submunitions 12, thereby endangering the desired rapid discharge of the submunitions 12 out of the load space 19. For that reason, a pyrotechnic ejection aid 34 is arranged within the load space 19 between its end 22 and the adjacent submunition 12. An explosive charge is not suitable for that purpose because, even if in the form of a low-pressure system with a uniform burning characteristic as in the case of the charges 28, 31, such an explosive charge would involve the application of an excessively high pulse-like pressure to the coaxial stack of submunitions 12 which are to be pushed out of the load space 19. That loading is critical in particular when the submunitions 12 are not mechanically stable shaped bodies but the above-mentioned surface defense mines with the bar structures of their support and holding arrangements (not shown in the drawing) which are connected thereto outside the peripheral surface of the actual operative part of the mine. Therefore, instead of an explosive charge, installed on the inside of the load space end 22 as the aid 34 for forward-oriented tail discharge of the submunitions 12 is a gas generator 35 as is used in mass production in private motor car airbags and is thus available at low cost and as an operationally reliable component, as a large-scale mass-produced product. The generator 35 sufficiently quickly supplies an adequate volume of gas to fill up the reduced pressure which otherwise occurs, and in addition also to build up a slight axial pressure as between the load space end 22 and the adjacent submunition 12, that pressure being sufficient also to overcome the frictional and dynamic pressure forces which are directed in opposite relationship to the inertia-induced discharge movement, at any event to such a degree as to ensure undisturbed fast axial discharge of the submunitions 12 out of the forwardly oriented, open load space tail 18.

The energy liberated by the gas generator 35 however may also be so great that it is sufficient to shear off holding means on the tail cover 25 so that there is no need here to provide a further detonative separation device (the function thereof could be endangered by the preceding operation of the motor separation device 16).

If the operative unit (gas generator 35) of the pyrotechnic ejection aid 34, for reasons of saving space, is not to be enclosed in a deployable enclosure, then the reaction gas can act directly on the adjacent end face of the submunitions 12. In order here to provide fault-free action over a large area and to avoid pressure losses by way of the free spaces between the bar structure on the outside peripheral surface of the respective item of submunition 12, a plate 12 which acts as a flat ejection piston in the load space 19 is disposed between the ejection aid 34 and the submunition 12 adjacent thereto. The plate 36 is tethered at an eccentrically disposed coupling point 37 by means of a line 38 to the load space end 22 so that the plate 36 does not issue from the load space 19 in a stable combination with the submunition 12, but is reliably deflected by the last submunition 12 issuing out of the path of movement thereof, by a pivotal or swing movement.

On leaving the load space tail 18 structural couplings in respect of the submunition stack are released. The axial stack of submunitions 12—12, which nonetheless initially flies in a stable condition, is separated by small pilot parachutes or drogues 39 (FIG. 7). They are successively released by means of pull-out lines 40; namely, firstly the pilot parachute 39 at the submunition which is last in the direction of flight, in relation to which the pull-out line 40 is fixed to the load space 19 or (better still) to the piston plate 36 (FIG. 5). The parachute 39 thus brakes the rearward submunition 12 relative to those which are in front of it, whereby a pull-out line 40 pulls out the pilot parachute 39 in the stack of submunitions 12—12, which has now remained behind it, in order then to be separated therefrom, and so forth (FIG. 7). Consequently only the submunition 12 which is at the very front requires no pilot parachute. As the pull-but lines 40 are each released from the respective front parachute 39 when opened, it can swing round to the rear and become entangled with its own pilot parachute 39, whereby release of the mine parachute 41 could be interfered with. It is therefore important to have short lines 40, as referred to above.

Finally, released for example by way of a pyrotechnic delay element (not shown in the drawing), the pilot parachutes 39 pull out on the respective submunition 12 the main or mine parachute 41 thereof (or firstly only an auxiliary parachute to provide for a further braking action), on which the respective submunition 12 (FIG. 8) reliably drops at a non-critical drop speed into the operational terrain 113, as the previously separated submunitions 12 can then no longer collide with those parachutes 41.

We claim:

1. A method of delivering a payload comprising a mine or submunition, through a projectile traveling over an operational terrain over which the payload is to be axially discharged from the projectile, the projectile being an artillery rocket having a tail motor and tail plane assembly, and a casing forming a payload space which is disposed in front of the motor in the direction of flight of the projectile and housing at least one payload; said method comprising the motor to cause the rocket to assume a ballistic trajectory;

opening a cup-shaped tail cover facing away from said casing for actuating a detaching charge arranged therein so as to separate said tail motor and said casing over the operational terrain to facilitate discharge of the payload at an open separation region between said casing and said motor the; deploying aerodynamic braking means located at a nose portion of the projectile for turning the casing responsive to aerodynamic braking subsequent to the motor having passed along the trajectory of the separated casing which has been separated therefrom and which has deviated from the ballistic trajectory; so that a tail end of the casing is facing forward in the flight direction and discharging said payload through said tail end of the casing.

2. A method according to claim 1, wherein a time delay is started for effectuating release of the aerodynamic braking means for the separated casing upon detachment of the tail motor.

3. Apparatus for delivering a payload (12) over an operational terrain (113) over which the payload (12) is axially discharged from a casing of a payload space (19) housing the payload, said apparatus comprising an artillery rocket (13) having a tail motor (17) and a tail plane assembly (27), at least one said payload (12) being housed in the payload space (19) in front of the tail motor (17) in the direction of flight of the rocket; a pyrotechnic charge for separating the payload space (19) from the tail motor (17) and causing an opening of a separation region; time delay means for starting the triggering of braking means on the casing of the payload space (19), said time delay means terminating when the tail motor (17) has passed the detached casing of the payload space (19) which reaches an aerodynamically unstable condition of flight; a cup-shaped tail cover (25) which opens away from the payload space (19) having a detaching charge (28) separating the tail motor (17) arranged therein; said braking means being located at a front end (22) of the casing of the payload space so that when the braking means is deployed the casing is turned so that its tail end (18) is facing forward in the direction of flight and ejection aid (34) discharging the payload from the tail end (18) of the payload space (19).

4. Apparatus according to claim 3, wherein the payload (12) is delivered by a parachute pulled coaxially out of said tail end (18) of the casing (19) which provides for an elongated hollow-cylindrical configuration of said payload space (19); pyrotechnic separation means (16, 24) being arranged between respectively the casing and the tail motor (17) and between the casing and a projectile nose cone (14); and pyrotechnic charges (28, 31) for rapidly increasing the mutual spacing between said separated components; a braking parachute (23) being coupled to said front end (22) of the casing which is deployed after the nose cone (14) has moved away and which places the tail end (18) leading in the direction of flight ahead of said ejection aid (34) which is operative between the casing front end (22) and the adjacent payload (12) housed in the casing then pushes a payload stack (12—12) leading in the direction of flight out of the payload space casing tail end (18).

5. Apparatus according to claim 4, wherein a plate (36) is arranged between a gas generator (35) and the adjacent payload (12), which serves as a flat ejection piston and which is tethered to the casing by a line (38).

6. Apparatus according to claim 4, wherein a pull-out line (40) is releasably fastened to a pilot parachute (39) with which the payload (12) is equipped and is also fastened rearwardly to the payload (12) in the ejection direction.

7. Apparatus according to claim 4, wherein upon the nose cone (14) moving away from the casing front end (22), the parachute (23) is released from a compartment (32), the compartment (32) being disposed in the nose cone (14) and which is open towards the casing and which surrounds a piston (51) in an annular configuration, is moved away from the front end (22) under coaxial guidance of piston (51) within a hollow cylinder (42).

8. Apparatus according to claim 7, wherein said parachute compartment (32) is pivotable by a central cup (43) relative to said piston (51) and is coaxially connected thereto.

9. Apparatus according to claim 4, wherein the payload (12) is surface defense mines having support and mounting means which bear against the outside of the mine bodies and provide for full-calibered filling of the casing.

* * * * *

UNITED STATES PATENT AND TRADEMARK OFFICE

CERTIFICATE OF CORRECTION

PATENT NO. : 5,760,330

DATED : June 2, 1998

INVENTOR(S) : Rainer Himmert, et al.

It is certified that error appears in the above-identified patent and that said Letters Patent is hereby corrected as shown below:

Column 11, Line 54, Claim 1: Delete --the--

Column 4, Line 7: "own" should read --blown--

Figure 9:

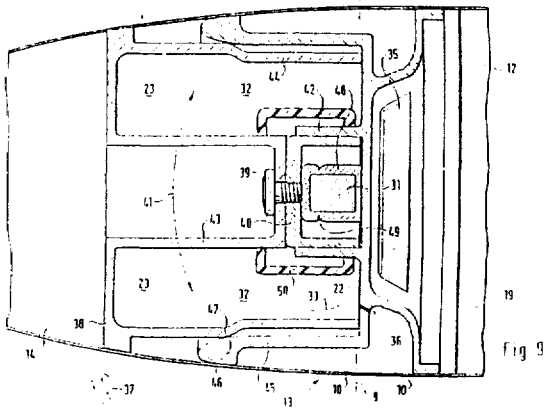

Fig 9

UNITED STATES PATENT AND TRADEMARK OFFICE

CERTIFICATE OF CORRECTION

PATENT NO. : 5,760,330

DATED : June 2, 1998

INVENTOR(S) : Rainer Himmert, et al.

It is certified that error appears in the above-identified patent and that said Letters Patent is hereby corrected as shown below:

"40" should read --51--

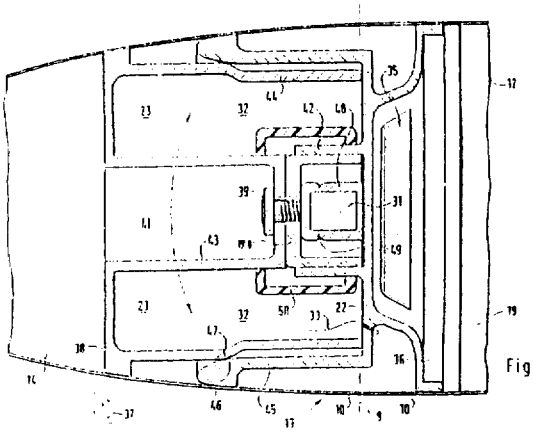

Fig 9

Signed and Sealed this

Seventeenth Day of April, 2001

*Attest:*

NICHOLAS P. GODICI

*Attesting Officer*

*Acting Director of the United States Patent and Trademark Office*